US006595153B2

(12) United States Patent
Booth et al.

(10) Patent No.: US 6,595,153 B2
(45) Date of Patent: Jul. 22, 2003

(54) APPARATUS FOR HOLDING A FLOATING VESSEL TO A FIXED LOCATION

(76) Inventors: Barry Booth, 2454 Key Largo La., Fort Lauderdale, FL (US) 33312; Scott Booth, 2454 Key Largo La., Fort Lauderdale, FL (US) 33312

( * ) Notice: Subject to any disclaimer, the term of this patent is extended or adjusted under 35 U.S.C. 154(b) by 0 days.

(21) Appl. No.: 09/896,398

(22) Filed: Jun. 30, 2001

(65) Prior Publication Data

US 2002/0040672 A1 Apr. 11, 2002

Related U.S. Application Data

(60) Provisional application No. 60/216,508, filed on Jul. 3, 2000.

(51) Int. Cl.[7] ..... B63B 21/00
(52) U.S. Cl. ..... 114/230.1
(58) Field of Search ..... 114/230.1, 218, 114/230.11, 230.15, 230.16

(56) References Cited

U.S. PATENT DOCUMENTS

| | | | | |
|---|---|---|---|---|
| 2,754,792 A | | 7/1956 | Baird | |
| 2,871,813 A | | 2/1959 | Klawitter | |
| 3,081,731 A | | 3/1963 | McEvoy | |
| 3,238,912 A | * | 3/1966 | Perlick | 114/230.1 |
| 3,389,675 A | * | 6/1968 | Kieft et al. | 114/230.1 |
| 3,442,241 A | * | 5/1969 | Daunis | 114/230.1 |
| 5,301,628 A | | 4/1994 | Parsons | 114/230 |
| 5,493,991 A | | 2/1996 | Wright et al. | 114/230 |
| 5,575,234 A | | 11/1996 | Dysarz | 114/230 |
| 5,676,085 A | | 10/1997 | Michl, Jr. | 114/230 |
| 6,000,356 A | | 12/1999 | Vanassche et al. | 114/230 |

FOREIGN PATENT DOCUMENTS

| | | | | |
|---|---|---|---|---|
| CA | 600539 | * | 6/1960 | 114/230.1 |

* cited by examiner

*Primary Examiner*—Stephen Avila
(74) *Attorney, Agent, or Firm*—Malin, Haley & DiMaggio, P.A.

(57) ABSTRACT

A simple and compact Apparatus for holding a floating vessel to a fixed location without the use of ropes or flexable fastenings, connecting to existing hardware on vessel with a quick release mechanism, preventing any movement away from the dock as viewed from above, but allowing for three plains of movement associated with water, vertical tidal movement, rocking wave movement, and front to back dipping movement. A preferred embodiment includes that it retains the said vessel closer than any prior art making it impossible to fall between vessel and fixed location thus making it the safest docking system available.

21 Claims, 6 Drawing Sheets

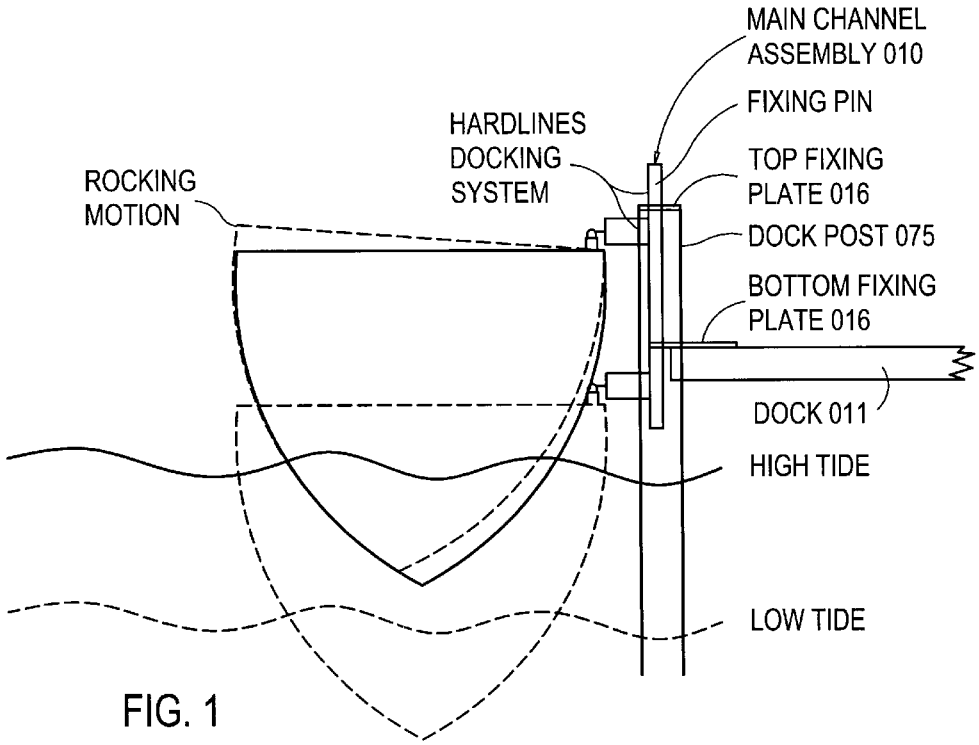
FIG. 1
FIG. 2
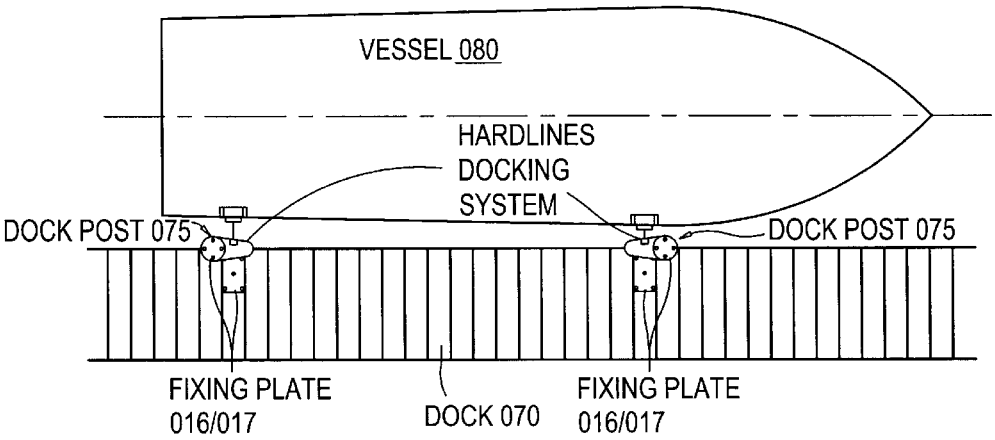

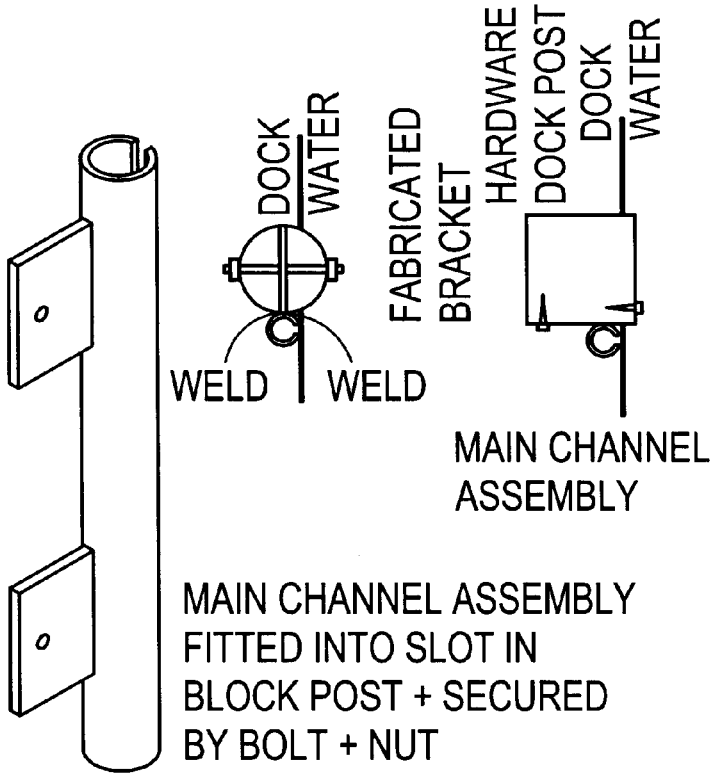
FIG. 9
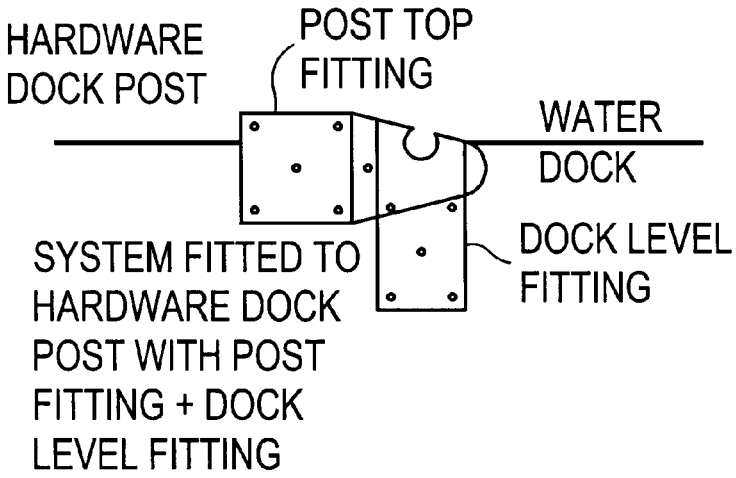

APPARATUS FOR HOLDING A FLOATING VESSEL TO A FIXED LOCATION

CROSS REFERENCES TO RELATED APPLICATION

This is a continuation in part of Ser. No. 60/216,508 filed Jul. 3, 2000.

BACKGROUND OF THE INVENTION

This invention relates generally to the field of mooring devices, and more particularly to apparatus for holding a floating vessel to a fixed location by mechanical means safely and securely with ease of connection. Also maintaining a constant close proximity to the fixed location.

The problems associated with retaining a floating vessel to a fixed location have been around for centuries. In recent years a few attempts have been made to overcome these problems, but until now and this invention some of the problems have persisted. We have eliminated these problems simply and efficiently as laid out in this document. Other devices have been around for hundred of years, ropes have been used reasonably successfully for many centuries and some recent inventions have worked quite well on a few applications. The problem with ropes in tidal areas especially, is it needs constant adjustment, and allows the vessel to hit the dock. It becomes slack at certain tides allowing the vessel to move away from the dock and become difficult and dangerous to board. It also allows the vessel to gain momentum putting unnecessary stress on both the vessel and dock. A device called a fender was invented to prevent damage to the side of the vessel when it hits the dock, but these often slip out of place as any boating person knows.

Some recent inventions have pivoting arms to hold the vessel off the dock which is alright on floating docks or non tidal areas. But the arms have to be so long, especially in large tidal areas that it makes boarding the vessel extremely difficult, especially by young children and elderly boaters. As portrayed in U.S. Pat. Nos. 6,000,356, 3,081,731 and 5,575,234.

Other inventions are using a kind of sliding mechanism simular to our invention but they incorporate the use of ropes along with the track. This means the vessel has to be fixed at several points to prevent hitting the dock, and the difficulty of tieing the ropes to the system and vessel still exists as in U.S. Pat. No. 5,301,628.

One system as in above paragraph incorporates both rope and track, but holds the vessel tight against the post which will eventually damage the vessel and dock post through wear and tear. Their own literature states that it can not be used on straight sided boats and many other types of vessels for many reasons see U.S. Pat. No. 5,301,628.

Another device not only relies on long arms, but also relies on suckers to attach itself to the side of the vessel, I wouldn't rely on a sucker to hold my cup to the wall, especially if it's my favorite one. U.S. Pat. No. 5,676,085.

Yet another device utilizes a track and long hold out arms, again it holds the vessel too far off the dock and I don't know what holds the arm level? U.S. Pat. No. 2,871,813. It also has an ugly permanent fixing on the side of the vessel.

One other system portrayed in U.S. Pat. No. 5,493,991 utilizes track and rod and because of its complexity again holds the vessel a long way off the dock. It also incorporates springs and specialized fittings on the side of the vessel.

The final system sited is simplicity in itself and has been around for some time, according to its patent date 1956 U.S. Pat. No. 2,754,792. Even though being in the marine industry I have never come across their product either in advertisement form or real life. The system is so loose fitting it will be noisy and relies on an ugly permanent fixture on the outside of the vessel. This would be dangerous when the vessel is away from the dock.

Our invention overcomes all the prior arts deficiencies because it retains the vessel closer to the dock than any other, is for any size or shape of vessel. Most of the prior art states they are designed for small craft, and personal watercraft. Our system requires no ropes or fenders, leaves no part of the system attached to the vessel when not at the dock, takes only seconds to engage or disengage, and fits to existing hardware already fitted to the vessel. It is also very attractive, simple in design, virtually maintenance free, cost efficient, and easy to install.

SUMMARY OF THE INVENTION

The primary object of the invention is to provide a better docking system that uses no ropes. Holding the vessel only inches away from the dock at all times, yet preventing it from touching without the use of fenders.

A further object of the invention is its a very simple and compact mechanism. Easy to manufacture and therefore keeping costs to a minimum Still yet another object of the invention is silent operation. No complicated parts making it virtually maintenance free Another object of the invention is no clutter on the dock or vessel due to ropes or fenders.

Yet another object of the invention is it can be used on any size of vessel.

Still yet another object of the invention is Takesutilizesapparatus onlydisconnect secondsconnect to conect or disconect, and it utalizes existing hardware already fitted to the vessel to make it's connection.

Another object of the invention is no part stays of the apperatus remains on the vessel when away from the dock.

Yet another object of the invention is because of the closeness to the dock a person can not fall between the two.

Other objects and advantages of the present invention will become apparent from the following descriptions, taken in connection with the accompanying drawings, wherein, by way of illustration and example, an embodiment of the present invention is disclosed.

A simple and compact Apparatus for holding any size floating vessel very close to a fixed location without the use of ropes or flexable fastenings, connecting to existing hardware on vessel with a quick release mechanism, preventing any movement away from the dock as viewed from above, but allowing for three plains of movement associated with water, vertical tidal movement, rocking wave movement, and front to back dipping movement.

The drawings constitute a part of this specification and include exemplary embodiments to the invention, which may be embodied in various forms. It is to be understood that in some instances various aspects of the invention may be shown exaggerated or enlarged to facilitate an understanding of the invention.

BRIEF DESCRIPTION OF THE DRAWINGS

FIG. 1 is a front elevation showing connection of vessel to fixed point portraying it's closeness to the fixed point at various tides.

FIG. 2 is a plan view of the invention showing a side to docking of vessel.

FIG. 9 shows various fixing methods to secure the invention.

Drawing Reference Numerals Worksheet

Figure 3:
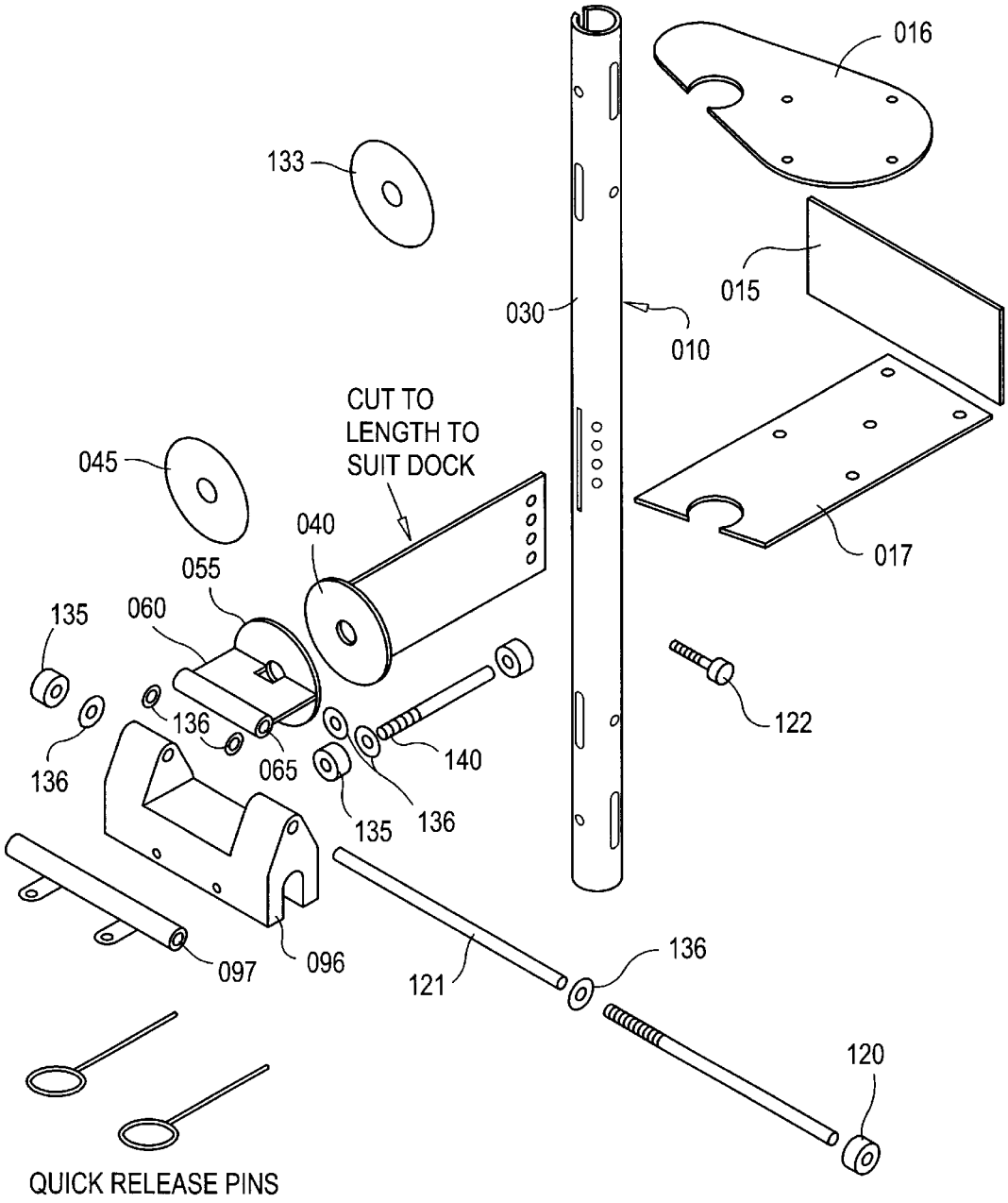
FIG. 3 is an isometric exploded view of the invention showing all components necessary for one assembly needed in a two identical part total system.

| Part Name |
|---|
| 010 Main Channel Assembly |
| 015 Mid Fixing Plate |
| 016 Top Fixing Plate |
| 017 Bottom Fixing Plate |
| 020 Fixing Band |
| 025 Slider Assembly |
| 030 Slider |
| 035 Slider Arm |
| 040 Slider Arm Swivel Plate |
| 045 Swivel Plate Washer |
| 050 Swing Arm Assembly |
| 055 Swing Arm Swivel Plate |
| 060 Swing Arm |
| 065 Swing Arm Tube |
| 070 Dock/Fixed Location |
| 075 Dock Post |
| 080 Vessel |
| 085 Genoa Track |
| 086 Genoa Carriage |
| 087 Toe Rail Typical |
| 096 Overcleat |
| 097 Standard Boat Cleat |
| 098 Pop Up Boat Cleat |
| 100 Cleat Base |
| 105 Cleat Up stand |
| 110 Cleat Tubes |
| 120 Swing Arm Joining Bolts |
| 121 Swing Arm Sleeve |
| 122 Shoulder Bolts |
| 131 Quick Release Pins |
| 133 Wheels |
| 135 Nuts |
| 136 Washers |
| 140 Bolts |
| 150 Rag Bolts |

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

With reference to the drawing sheets numbered 1 through 7 and figures numbered 1 though 9, and reference to all parts and numbers we hereby set out to describe our invention. Which comprises of a simple compact apparatus for holding a vessel to a fixed location, without the use of ropes or flexible fixings that connects the said vessel to the said fixed location utilizing existing hardware on the vessel in most cases. The invention preventing any movement away from the fixed location as viewed from above, while allowing the three plains of movement associated with a marine environment, namely, vertical tidal movement, rocking wave movement, and back to front dipping movement. The invention retaining the vessel closer and safer than any prior art, making it impossible to fall between the vessel and fixed point. The design relying on its rigidity to prevent any momentum from building up due to current or wind, which causes much damage in other systems.

FIG. 1 as shown the first embodiment is a vertical slotted channel 010 fixed by any of several means shown in FIG. 9 to the side or front of a dock post 075, but most commonly by means of a top fixing plate 016, a bottom fixing plate 017, and in cases of large tidal areas mid fixing plate/s 015. This by means of parts described later holds the vessel exceptionally close to the fixed dock 070 allowing for tidal and other types of water movement.

FIG. 2 shows an aerial view of the vessel 080 standing alongside a dock 070 and attached by two docking systems connecting two dock posts 075 and portraying the close proximity to the dock 070.

FIG. 3 Shows an isometric exploded view of the complete hardlines docking system explained as follows; The slotted channel 010 slides through the almost full circular holes in the fixing plates 016 and 017 with extra mid plates 015 welded on in extreme cases. The plates 016, 017, and 015 (if necessary) are then secured to the dock posts 075 by of rag bolts, nuts and bolts etc. The slider 030 complete with wheels 133 fitted through slots in the slider 030 and secured with one shoulder bolt 122 per wheel 133 and the slider arm 035 fixed in place by means of several shoulder bolts 122 is then slid down the slotted channel (main channel assembly) 010 to an approximate level of the side of the vessel 080. The slider arm 035 which is always vertical in orientation is welded to a circular slider arm swivel plate 040 which is separated from the circular swing arm swivel plate 055 by a swivel plate washer 045 made of a material to reduce friction. All swivel plate parts connected by a single nut 135 and bolt 140 and two washers 136 in the center tightened just enough to hold the two swivel plates 040 and 055 firmly together but not too tight to prevent the swivel plates 040 and 055 from rotating separately allowing for dipping motion of the vessel. The swing arm swivel plate 055 is welded to the swing arm 060, which is always in a horizontal orientation, and has a swing arm tube 065 welded along its other edge. Which in turn is connected to the over cleat 096 by means of a bolt 120 which passes through an antifriction swing arm sleeve 121 and is secured by a nut 135. Four washers 136 also being used, one between the head of the bolt 120 and the over cleat 096, one at either end of the swing arm tube 065, and one separating the nut 135 from the over cleat 096. The over cleat 096 then passes over the fixing point on the vessel 080, in this drawing a standard cleat 097 and is secured by quick release pins 131. To release the vessel from the dock the quick release pins 131 are all that has to be removed, and the reverse for docking.

Figure 4:
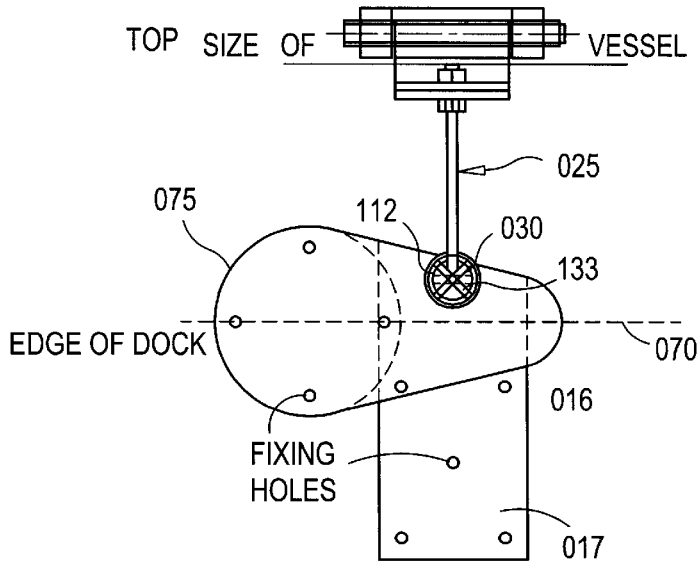
FIG. 4 is a plan of one dock post fixture.

FIG. 4 shows a close up aerial view of one dock post 075 fitting and displays the positions of the slider arm assembly 025 in relation to the slotted main channel assembly 010 and also shows the position of the wheels 133 and portrays the wheels 133 being smaller than the inside of the main channel assembly 010 so that only one edge of each wheel can come into contact with the tube at any given time thus allowing for free movement of the slider 030.

Figure 5:
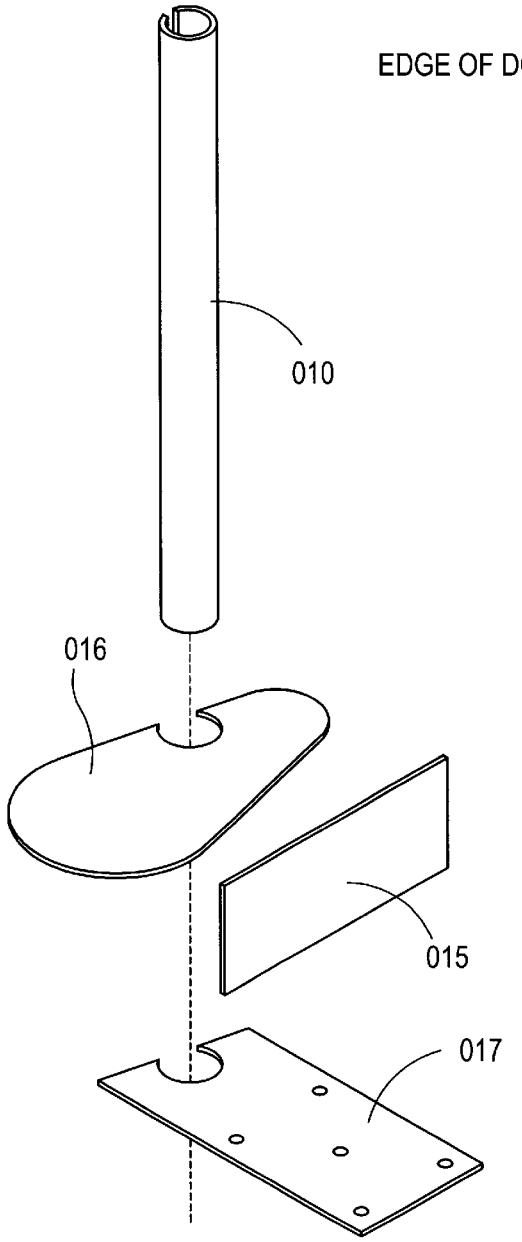
FIG. 5 is an isometric exploded view of one dock post fixture.

FIG. 5 shows how the main channel assembly fits through the fixing plates 016 and 017. Any mid fixings using the same method (not shown)

Figure 6:
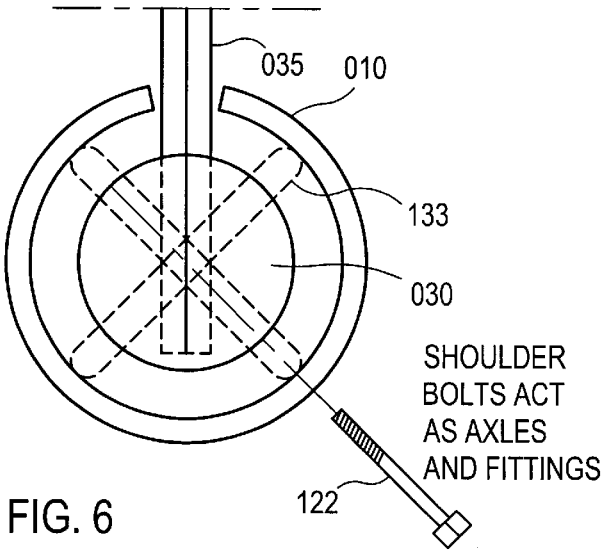
FIG. 6 is the plan of wheel and slider arm locations in relation to main channel assembly slot.

FIG. 6 shows a close up of the wheels 133 inside the main channel assembly 010 and the direction of the shoulder bolt 122 to one of the wheels 133. The wheels 133 being at 90 degrees to each other, and the slider arm 035 is at 45 degrees to the wheels 133.

Figure 7:
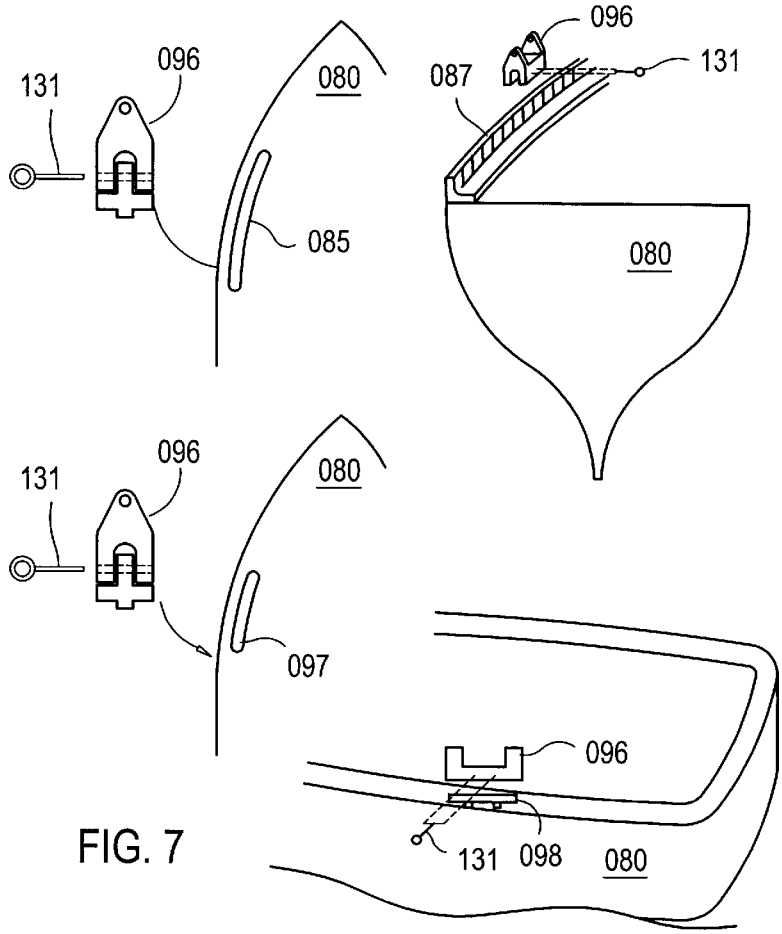
FIG. 7 is several methods of attaching the over cleat topositions existing parts on the vessel.

FIG. 7 shows various methods of attaching the over cleat 096 to various types of vessel. 7A being fitted to a genoa track 085. 7B being attached to a toe rail 087. 7C to a standard boat cleat as in drawing FIG. 3. 7D being fitted to a pop up cleat 098.

Figure 8:
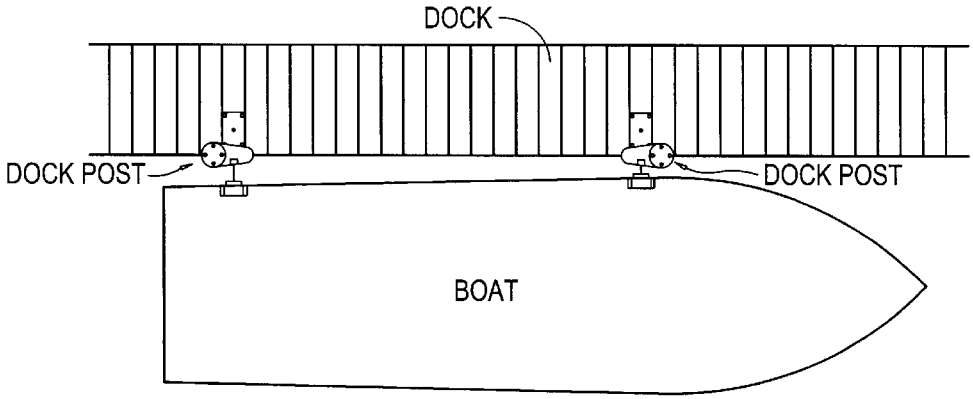
FIG. 8 relates to several different docking possitions of vessel to dock using our invention.
Figure 8:
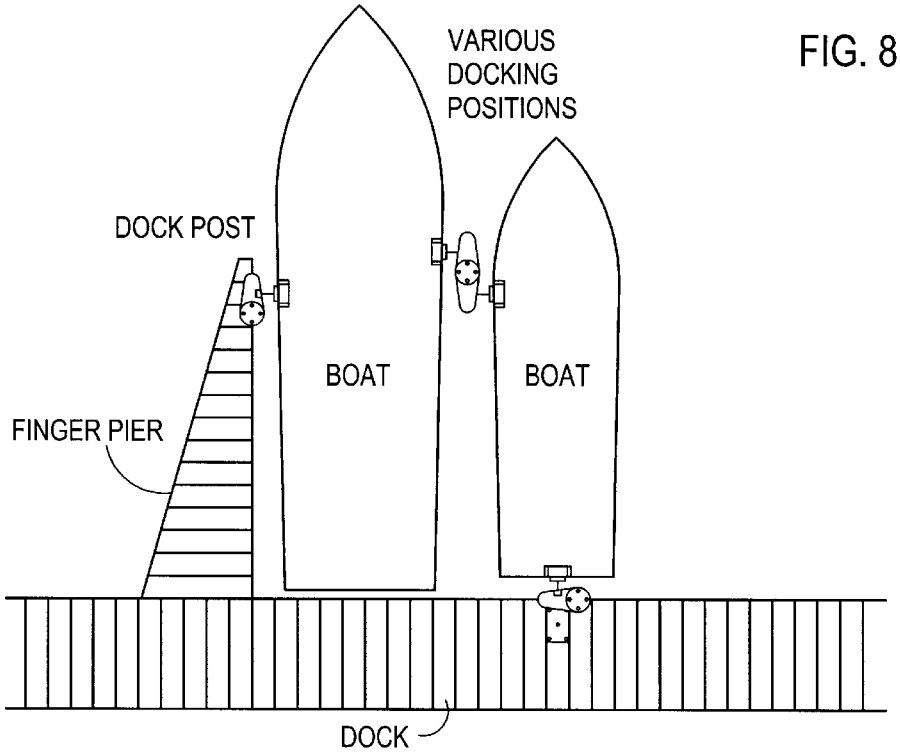

FIG. 8 shows various vessels 080 configuration relative to usual fixed location (docks 070)

FIG. 9 shows various fixing methods to secure our invention to different kinds of dock posts 075.

Also shown in FIG. 8, is the system of the present invention fitted to a square dock post with a post fitting and a docket level fitting. Main channel assembly is shown fitting into a slot in the block post and secured by a bolt and nut. The size of each of the components of the docking system depend upon the size of the boat being secured. The components of the docking system can be built of any suitable material such as aluminum, steel, stainless steel, copper, bronze, iron, plastic or composite material. In FIG. 3, overcleat 096 can be machined to fit over any cleat or to fit any Genoa track or toe rail. In FIG. 6 shoulder bolt 122 acts as axles and fittings.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A system for holding a vessel floating in water to a fixed location without the use of ropes or flexible fastenings, said system comprising:

one or more hollow support masts, each having a slotted channel vertically disposed along its length;

securing means for securing each said one or more support masts to a dock post, said dock post protruding upwards from a dock; and one or more boat securing assemblies, each said one or more assemblies slidably secured within said slotted channel of said mast support and adapted for removable attachment to existing hardware on or within a vessel, wherein said vessel is kept at a substantially close and constant distance from the dock regardless of vertical tidal movement, rocking wave movement and front to back dipping movement, said one or more boat securing assemblies positioned at substantially the same height as said existing hardware within said vessel.

2. The system of claim 1 wherein each said boat securing assembly comprises:

a slider mast to be rotatably received within said slotted channel of said support mast;

a substantially vertical slider plate having first and second ends, said first ends affixed to said slider mast;

a slider arm swivel plate rotatably affixed to said second end of said slider plate;

a swing arm swivel plate having inside and outside faces;

a swing arm affixed to said outside face of said swing arm swivel plate;

friction reducing means situated between said slider arm swivel plate and said swing arm swivel plate to allow for free independent rotation of each said plate to accommodate motion of said vessel; and vessel attachment means affixed to said swing arm for removable attachment to existing hardware on or within said vessel.

3. The system in claim 1 wherein said vessel attachment means comprises an overcleat device releasably secured to said swing arm via securing means, wherein said overcleat device is adapted to fit over any existing vessel cleat, Genoa track, or toe rail upon said vessel.

4. The system of claim further comprising one or more dock post securing plates affixed to said dock post, each said one or more dock post securing plates adapted to attach to a portion of each said support mast to secure each said support mast alongside said dock post wherein each said support mast does not protrude past said dock post toward the water.

5. The system of claim 2 wherein said friction reducing means comprises a swivel friction washer.

6. The system of claim 3 further comprising vessel releasing means to easily separate said one or more boat securing assemblies from said vessel.

7. The system of claim 3 further comprising vessel securing means to further secure said one or more boat securing assemblies to said vessel.

8. The system of claim 6 wherein said vessel releasing means comprises one or more quick release pins wherein said pins, after their insertion within said overcleat device, are removed.

9. The system of claim 7 wherein said vessel securing means comprises one or more quick release pins that are inserted within said overcleat device to further secure said overcleat to the existing hardware on or within said vessel.

10. The system of claim 1 wherein the system maintains the vessel at a constant distance of approximately 6 inches from the dock.

11. An apparatus for holding a vessel floating in water to a non-floating fixed location without the use of ropes or flexible fastenings, when used with a second said apparatus, said apparatus comprising:

a hollow support means mast having a slotted channel vertically disposed along its length;

a mast securing assembly, said hollow support mast adapted for attachment to a post-like member of a fixed location by said mast securing assembly, said post-like member protruding upwards from the fixed location; and a boat securing assembly, said assembly slidably secured within said slotted channel of said mast support, said boat securing assembly adapted for removable attachment to a vessel, wherein said vessel is kept at a substantially close and constant distance from the fixed location regardless of vertical tidal movement, rocking wave movement and front to back dipping movement, said boat securing assembly positioned at substantially the same height as its removable attachment point to said existing vessel, wherein said boat securing assembly is detached from the vessel while the vessel is in use.

12. The apparatus of claim 11 wherein said boat securing assembly comprises:

a slider mast rotatably received within said slotted channel of said support mast;

a substantially vertical slider plate having first and second ends, said first end affixed to said slider mast;

a slider arm swivel plate rotatably affixed to said second end of said slider plate;

a swing arm swivel plate having inside and outside faces;

a swing arm affixed to said outside face of said swing arm swivel plate;

friction reducing means situated between said slider arm swivel plate and said swing arm swivel plate to allow for free independent rotation of each said plate to accommodate motion of said vessel; and vessel attachment means affixed to said swing arm for removable attachment to said vessel.

13. The apparatus in claim 12 wherein said vessel attachment means comprises an overcleat device releasably secured to said swing arm via securing means, wherein said overcleat device is adapted to fit over any existing vessel cleat, Genoa track, or toe rail upon said vessel.

14. The apparatus of claim 11 further comprising one or more post securing plates affixed to said post-like member, each said one or more post securing plates adapted to attach to a portion of each said support mast to secure said support mast alongside said post-like member such that said support mast does not protrude past said post-like member toward the water.

15. The apparatus of claim 12 wherein said friction reducing means comprises a swivel friction washer.

16. The apparatus of claim 13 further comprising vessel releasing means to easily separate said boat securing assembly from said vessel.

17. The apparatus of claim 13 further comprising vessel securing means to further secure said boat securing assembly to said vessel.

18. The apparatus of claim 16 wherein said vessel releasing means comprises a quick release pin assembly wherein said pin assembly, after its insertion within said overcleat device, is removed to quickly release said vessel from attachment to the fixed location.

19. The apparatus of claim 17 wherein said vessel securing means comprises a quick release pin assembly, wherein said quick release assembly is inserted within said overcleat device to quickly secure said overcleat to said vessel at the fixed location.

20. The system of claim 11 wherein the apparatus maintains the vessel at a constant distance of approximately 6 inches from the fixed location.

21. An apparatus for holding a vessel floating in water to a non-floating dock without the use of ropes or flexible fastenings, when used with a second said apparatus, said apparatus comprising:

a hollow support mast having a slotted channel vertically disposed along its length;

a mast securing assembly, said hollow support mast adapted for attachment to a dock post of a dock by said mast securing assembly, said dock post protruding upwards from the dock;

a boat securing assembly, said assembly slidably secured within said slotted channel of said mast support, said boat securing assembly adapted for removable attachment to a vessel, wherein said vessel is kept at a substantially close and constant distance from the dock regardless of vertical tidal movement, rocking wave movement and from to back dipping movement, said boat securing assembly positioned at substantially the same height as its removable attachment point to said existing vessel, wherein said boat securing assembly is detached from the vessel while the vessel is in use;

said boat securing assembly comprises:

a slider mast rotatably received within said slotted channel of said support mast;

a substantially vertical slider plate having first and second ends, said first end affixed to said slider mast;

a slider arm swivel plate rotatably affixed to said second end of said slider plate;

a swing arm swivel plate having inside and outside faces;

a swing arm affixed to said outside face of said swing arm swivel plate;

a swivel friction washer situated between said slider arm swivel plate and said swing arm swivel plate to allow for free independent rotation of each said plate to accommodate motion of said vessel; and vessel attachment means affixed to said swing arm for removable attachment to said vessel, said vessel attachment means comprising an overcleat device releasably secured to said swing arm via securing means, wherein said overcleat device is adapted to fit over any existing vessel cleat, Genoa track, or toe rail upon said vessel;

one or more post securing plates affixed to said post, each said one or more post securing plates adapted to attach to a portion of each said support mast to secure said support mast alongside said dock post such that said support mast does not protrude past said post toward the water;

vessel releasing means to easily separate said boat securing assembly from said vessel, said vessel releasing means comprising a quick release pin assembly wherein said pin assembly, after its insertion within said overcleat device, is removed to quickly release said vessel from attachment to the fixed location; and vessel securing means to further secure said boat securing assembly to said vessel, said vessel securing means comprising a quick release pin assembly, wherein said quick release assembly is inserted within said overcleat device to quickly secure said overcleat to said vessel at the fixed location.

* * * * *